US007269915B2

(12) United States Patent
Flechsig et al.

(10) Patent No.: US 7,269,915 B2
(45) Date of Patent: Sep. 18, 2007

(54) SHOE WITH BUILT IN MICRO-FAN

(76) Inventors: Drew Flechsig, 3100 Greencastle Rd., Burtonsville, MD (US) 20866; Thomas Flechsig, 3100 Greencastle Rd., Burtonsville, MD (US) 20866

( * ) Notice: Subject to any disclaimer, the term of this patent is extended or adjusted under 35 U.S.C. 154(b) by 316 days.

(21) Appl. No.: 10/830,605

(22) Filed: Apr. 23, 2004

(65) Prior Publication Data

US 2005/0235523 A1 Oct. 27, 2005

(51) Int. Cl.

| | |
|---|---|
| ***A43B 7/06*** | (2006.01) |
| ***A43B 7/08*** | (2006.01) |
| ***A43B 17/08*** | (2006.01) |
| ***A43B 5/00*** | (2006.01) |
| ***A43B 23/00*** | (2006.01) |

(52) U.S. Cl. ..... 36/3 R; 36/3 A; 36/136; 36/114

(58) Field of Classification Search ..... 36/3 R, 36/3 A, 3 B, 29, 136, 114
See application file for complete search history.

(56) References Cited

U.S. PATENT DOCUMENTS

| | | | | |
|---|---|---|---|---|
| 3,027,659 | A | 4/1962 | Gianola | |
| 3,048,931 | A | 8/1962 | Farinello | |
| 3,273,264 | A | 9/1966 | Farinello | |
| 5,401,039 | A | 3/1995 | Wolf | |
| 5,551,172 | A | 9/1996 | Yu | |
| 5,813,140 | A | 9/1998 | Obeid | |
| 5,918,381 | A | 7/1999 | Landry | |
| 6,041,518 | A | 3/2000 | Polycarpe | |
| 6,227,458 | B1 * | 5/2001 | Dever et al. | 36/91 |
| 6,865,825 | B2 * | 3/2005 | Bailey et al. | 36/29 |
| 2005/0060906 | A1 * | 3/2005 | Zimerfeld | 36/3 R |
| 2005/0183286 | A1 * | 8/2005 | Crary | 36/3 B |

* cited by examiner

*Primary Examiner*—Anthony Stashick
(74) *Attorney, Agent, or Firm*—J. John Shimazaki

(57) ABSTRACT

The present invention relates to a shoe with a built in micro fan located on the shoe covering, such as above the toe area, to provide air circulation and increased comfort to the wearer. The shoe is preferably adapted with one or more improvements, such as a protective cover that protects the fan from debris and damage on the covering, a small rechargeable power source, and an easy to use on/off switch.

20 Claims, 5 Drawing Sheets

SERIES-SWITCH CONFIGURATION

PARALLEL-SWITCH CONFIGURATION

Micro Fan Product Specification Matrix

| Manufacturer/ Distributor | Model | Size (mm) | Voltage (V) | Current (mA) | Max Airflow (CFM) | RPM | Noise (dBA) |
|---|---|---|---|---|---|---|---|
| Sunon Inc | 38551 | 8x8x5 | 3 | 63 | 0.01 | 11,000 | 25.4/10cm |
| Sunon Inc | 39851 | 9x9x8 | 3 | 50 | 0.02 | 7,500 | 25.4/30cm |
| Sunon Inc | 5C851 | 12x12x8 | 5 | 70 | 0.12 | 13,500 | 25.4/50cm |
| Sunon Inc | 5F852 | 15x15x8 | 5 | 48 | 0.39 | 15,000 | 27.6/50cm |
| Sunon Inc | GM0501P FV3-8 | 20x20x8 | 5 | 60 | 1.1 | 10,000 | 15 |
| Sunon Inc | GM0502P EV3-8 | 25x25x7 | 5 | 40 | 1.4 | 7,000 | 15 |
| Sunon Inc | GM0502P EV2-8 | 25x25x7 | 5 | 60 | 2.2 | 10,000 | 23 |
| ADDA | AD2005L X-K71 | 20x20x6 | 5 | 50 | 0.58 | 10,500 | 19.5 |
| JARO | AD2005L B-K70 | 20x20x6 | 5 | 50 | 1.04 | 10,500 | 17 |

FIG. 8

SHOE WITH BUILT IN MICRO-FAN

FIELD OF THE INVENTION

The present invention relates to the field of shoes, and in particular, to an improvement in the design of shoes having one or more micro fans to facilitate airflow around the foot and provide increased comfort thereto.

SUMMARY OF THE INVENTION

It is well known that shoes that are worn for a long period of time can lead to heat build up and discomfort. The lack of ventilation surrounding the foot, for example, can cause the shoe to become warm and damp, wherein odor-causing substances can be released by the foot, and into the shoe, which can be difficult to remove.

Attempts have been made in the past to create shoes with miniature fans to circulate air within the shoe. For example, such a shoe is shown in U.S. Pat. No. 6,041,518 issued to Polycarpe, wherein a battery powered fan is located within the sole of the shoe. Other ventilated shoes with fans located in the sole are shown in U.S. Pat. No. 5,918,381 issued to Landry; U.S. Pat. No. 5,813,140 issued to Obeid; U.S. Pat. No. 3,273,264 issued to Farinello, Jr.; and U.S. Pat. No. 3,048,931 issued to Farinello, Jr.

While these attempts have incorporated ventilating fans, they all relate to shoes with fans located within the sole of the shoe. That is, in each case, the fan is located in the sole, not the upper or shoe covering, wherein the sole is modified to enable the fan to be housed therein. The disadvantages are as follows: First, putting a fan inside the sole can reduce shoe performance, since performance is often determined by the quality and characteristics of the sole. Second, having a fan built into the sole can reduce the durability of the sole and therefore the shoe. Third, installing a fan within the sole can make the shoe more expensive to manufacture, since in many cases, the sole can be the most expensive part of the shoe.

What is needed, therefore, is a shoe with a built in micro-fan for ventilating the inside of the shoe, wherein the fan is located on the upper or covering portion of the shoe, instead of the sole, and wherein the shoe can comprise one or more of the following: 1) means for mounting and protecting the fan on the upper or covering, 2) means for allowing the fan to be easily tuned on and off, and 3) a power source that can run for an extended period of time, and/or be recharged with relative ease.

SUMMARY OF THE INVENTION

The present invention relates to a shoe with a built in micro-fan for providing a practical and affordable way to eliminate the discomfort associated with wearing shoes for an extended period of time. Unlike past shoes with small fans, the present invention incorporates a micro-fan with a relatively flat orientation and protection means, capable of being secured to the upper or covering portion of the shoe, rather than the sole.

The shoe can be provided with one or more of the following features: 1) a protective cover which can be in the form of a pouch surrounding the fan, a fabric mesh, and/or a rigid cover or dome, 2) a small power source for providing power to the fan, which can be rechargeable, capable of being snapped into the heel, and/or adapted with a wall plug/jack, recharging mat, or motion activated self-charging battery, and 3) a switch for turning the fan on and off, wherein the switch can be located on the instep, and/or provided with a temperature sensor for automatically controlling the fan.

The present invention contemplates that, in one embodiment, the fan is located above the toe area of the shoe for maximum comfort, it can also be located on the instep, to be less noticeable, or other locations on the upper or covering. Channels and other formations that help to circulate air within the shoe can also be provided. Alternatively, more than one fan can be provided, i.e., dual fans, where one pushes air in and the other pulls air out. The shoe can also be provided with a deodorizer pouch or bladder, etc.

The fan preferably, although not necessarily, has the following features: 1) it can range in size from 8 mm×8 mm×5 mm to 40 mm×40 mm×8 mm; 2) it can have a volume capacity ranging from 0.1 cubic feet per minute to several cubic feet per minute, and 3) it can have an energy consumption of less than a few tenths of a watt. The battery also preferably allows the fan to run continuously for 8 to 10 hours.

BRIEF DESCRIPTION OF THE DRAWINGS

FIG. 8 shows a partial list of commercially available fans.

DETAILED DESCRIPTION OF THE INVENTION

The present invention and several of its embodiments are shown in FIGS. 1-4.

The shoe of the present invention can be any type of conventional shoe (or other foot-ware) having a sole and an upper or covering secured thereto, including athletic shoes, dress shoes, boat shoes, casual shoes, boots, sneakers, etc. The sole is preferably conventionally made, with design properties that are appropriate for the particular type and application. Likewise, the upper or covering can be made using any conventional type of fabric or other material (hereinafter "fabric"), including leather, canvas, cloth, mesh, etc., or a combination thereof. For example, in athletic shoes, the sole can be made of a conventional hard and durable material, while the upper can be made of leather, canvas, mesh, or a combination thereof. Dress shoes are typically made using leather, including both sole and upper.

Figure 1:
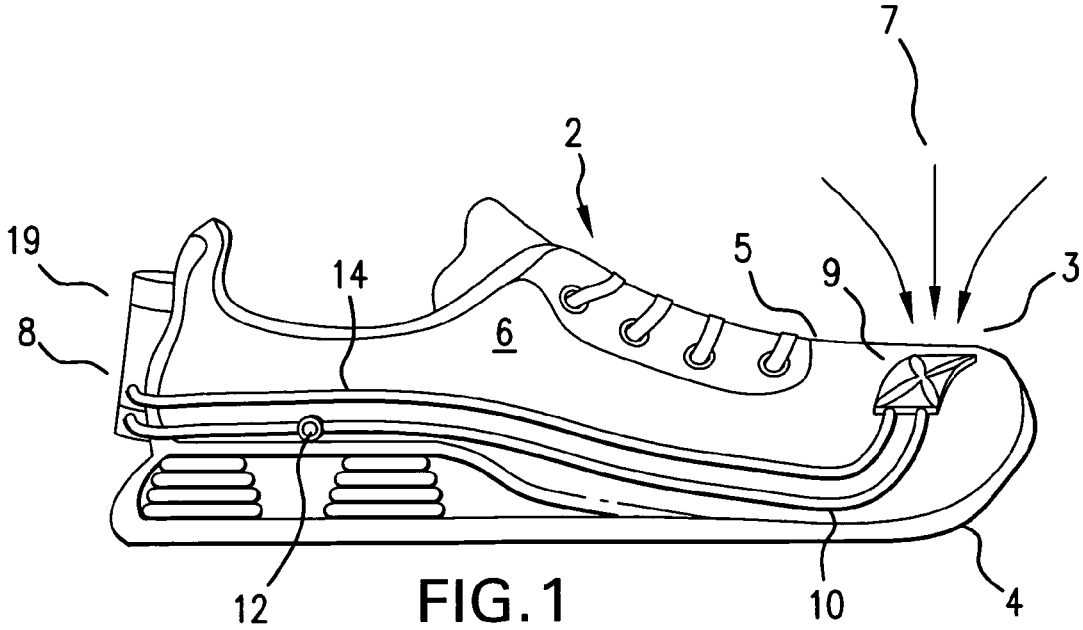
FIG. 1 shows an embodiment with a single fan and an air push design.

In FIG. 1, the first embodiment of shoe 2 is shown with a single fan 3 located on a toe area 7 of upper or covering 5. Fan 3 is preferably a DC powered micro-fan oriented relatively flat, wherein fan 3 is designed to be small enough so that it is virtually unnoticeable on the shoe. In this embodiment, the fan 3 is mounted and positioned so that air is pushed down (see arrows) onto the toes of the wearer, which is advantageous since the toes of the feet tend to be the area of most discomfort.

Fan 3 can be mounted on upper or covering 5 in one of several ways. First, fan 3 can be mounted directly onto the fabric 6 of upper 5 on the toe area 7, wherein tiny holes can be formed in the fabric 6 to enable air to pass through and into the shoe 2. A mesh screen 9 can also be secured and positioned above the fan 3, to cover fan 3 and provide protection against debris and other particles entering into fan 3. This is particularly useful in embodiments where fan 3 pushes air into the shoe from outside, wherein it is necessary to prevent airborne particles from entering into fan 3.

Mesh screen 9 can be either flexible or relatively rigid. A relatively rigid screen will provide the added safety of protecting fan 3 against physical damage, such as when the toe area 7 is accidentally stepped on, or when the wearer inadvertently kicks something with the shoe. A softer screen can also be provided to add flexibility to the toe area 7, which can be helpful in certain types of shoes, etc.

Figure 6A:
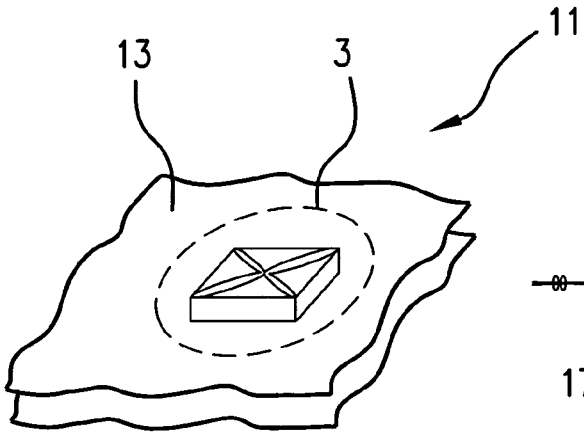
FIGS. 6A and 6B show a pouch for holding a fan.
Figure 6B:
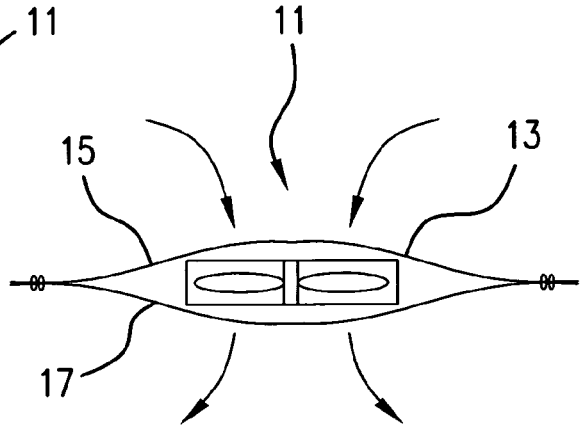

Second, fan 3 can be mounted to upper or covering 5 within a pouch 11 or similar sleeve, as shown in FIGS. 6A and 6B, made of porous fabric material 13. For example, fan 3 can be positioned between a top 15 and bottom 17 layer of fabric 13, wherein the layers can be stitched together around the periphery. This way, fan 3 can be secured to shoe 2 simply by sewing pouch 11 into fabric 6. This allows fan 3 to be easily and inexpensively integrated into upper or covering 5. One hole or a series of smaller holes can then be formed within fabric 6, adjacent fan 3, to improve air circulation into shoe 2.

Figure 7:
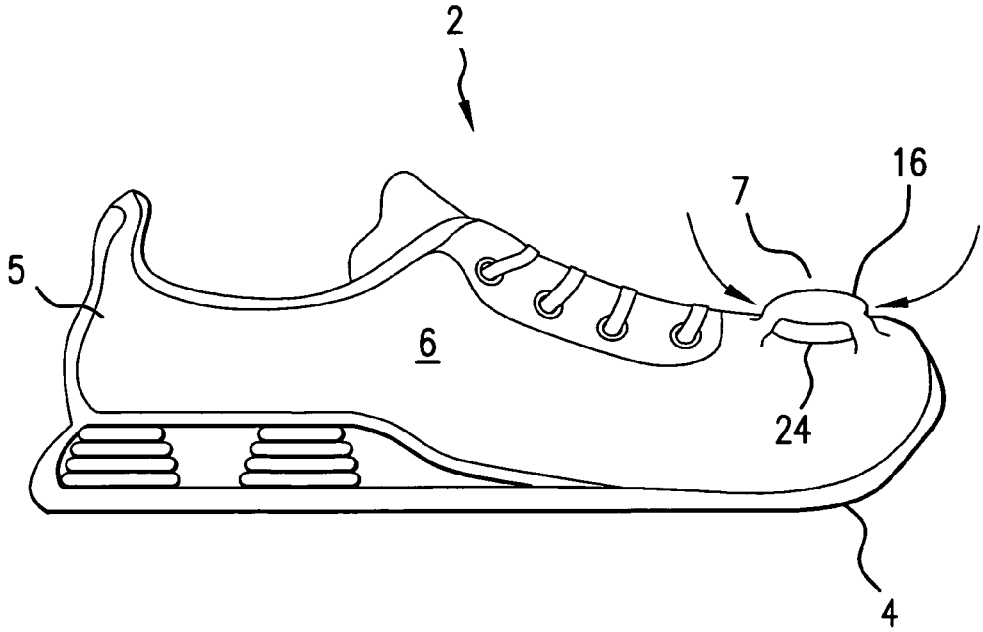
FIG. 7 shows an embodiment with a rigid protective cover for a fan.

Third, alternatively, a protective dome or cover 16 can be integrated into fabric 6, which can comprise hard rubber, leather, etc., around the toe area 7 of shoe 2, as shown in FIG. 7. In this design, the semi-rigid dome 16 provides a protective shield to prevent damage to fan 3 in the event that something impacts the toe of the shoe while still allowing air to flow through the access holes 24 under the edges of the dome 16. The dome 16 is preferably curved and/or has a contour to provide additional mechanical strength, preventing damage to fan 3 in the event that someone steps on the toe of the shoe. This dome cover 16 can be used in combination with either of the first two options, or by itself. Other mounting means are within the contemplation of the invention.

Placing fan 3 on upper or covering 5 makes the present invention simple, practical, reliable and minimizes manufacturing costs. This design provides improved reliability and robustness compared to designs that integrate fans into the sole of the shoe. One advantage is that the sole of the shoe does not need to be modified. This gives the shoe designer the complete freedom to design the sole for maximum shock absorption, support and comfort. Devices embedded in the sole of the shoe, as in past inventions, would otherwise be subject to repeated bending, flexing and constant compression that will eventually lead to device fatigue and failure. Integration of micro fans into the upper or covering provides greater air flow, leaves the sole unmodified allowing the sole to be designed for optimal foot support, improves reliability by positioning the fan where stresses are minimized, and improves ease of manufacture resulting in lower cost.

FIG. 1 shows a battery 8, which, in this embodiment, is located behind the heel 19 of shoe 2, although it can be located in any convenient location. Battery 8 provides a power source for fan 3 and is preferably connected to fan 3 via wire or cable 10. Preferably, battery 8 is capable of being recharged, and operates fan 3 for a minimum of 8 to 10 continuous hours, although this is not required. The heel 19 is an ideal location for battery 8, particularly when the battery is in the form of a removable pack, as shown. Other forms of power sources can also be used, as will be discussed.

On/Off switch 12 is preferably connected to fan 3 and battery 8, via wire or cable 10, to control the operation of fan 3. Switch 12 provides ON/OFF functional control of fan 3, and preferably comprises a single-pole, single-throw (SPST) pushbutton switch, located at the instep 14 of shoe 2. By positioning switch 12 at the instep 14, the wearer can activate/deactivate the fan 3 by pressing the button, using the heel of the other foot or shoe. This makes shoe 2 easy to use, since the wearer can control fan 3 without having to use his or her hands or bending over. The switch 12 can be located in any area that allows for easy activation.

Figure 2:
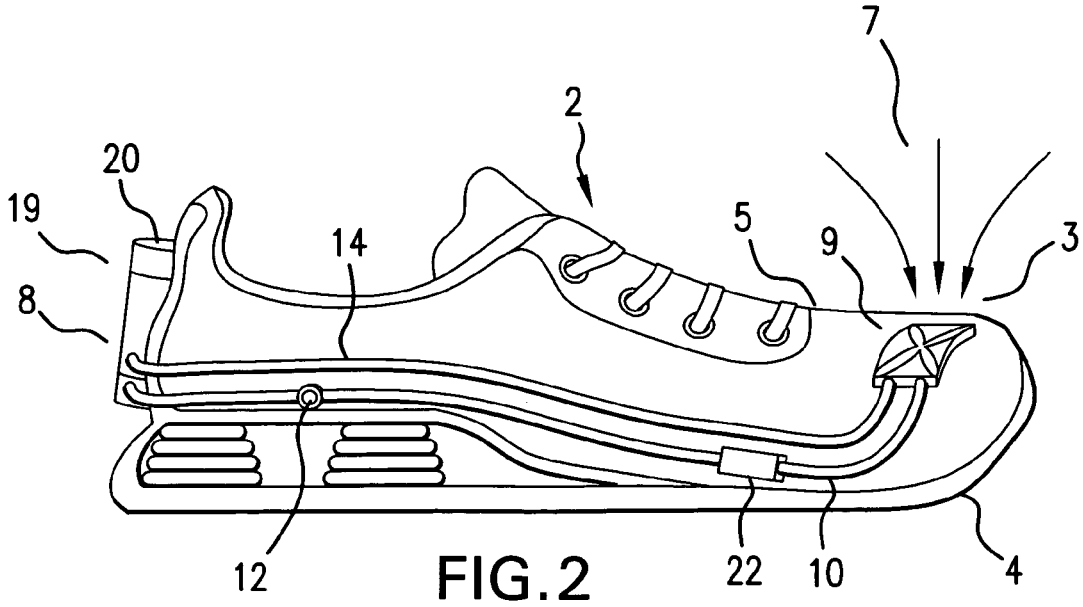
FIG. 2 shows an embodiment with a single fan and an air push design, along with a thermal control switch.

FIG. 2 shows a second embodiment 21 similar to the one in FIG. 1 in many respects, including that a single fan 3 is provided on the toe area 7, a battery 8 is provided at heel 19, an on/off switch 12 is provided at instep 14, and a wire or cable 10 is extended between battery 8 and fan 3. Similar mounting and protective means for fan 3 discussed above can also be used.

In this embodiment, an additional thermal control switch 22 is connected in series between switch 12 and the fan 3, on wire or cable 10. Thermal control switch 22 preferably comprises a bimetallic snap-acting thermostat or other temperature sensor that enables fan 3 to be automatically turned on and off whenever a preset temperature is reached within shoe 21. For example, the system can be set up so that when the temperature in shoe 2 exceeds a certain threshold, fan 3 automatically turns on, and when the temperature goes below that threshold, the fan 3 automatically turns off.

Figure 5A:
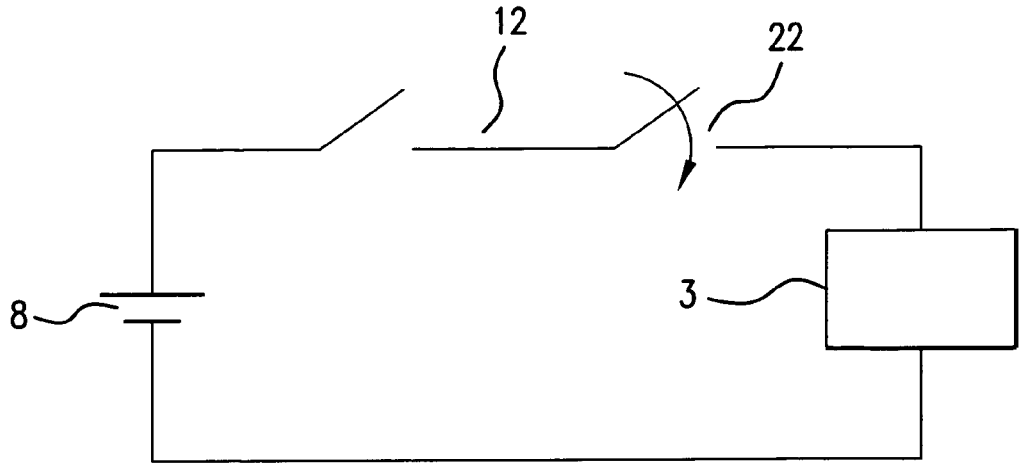
FIG. 5A shows an electrical diagram of the embodiment of FIG. 2.

The temperature-dependent thermal switch 22 turns the fan 3 on only when the temperature exceeds a predetermined threshold. This enhancement provides temperature-controlled fan operation, improves the efficiency of the fan, and conserves battery life since the fan only operates when needed. An added benefit is that the fan automatically turns off when the shoe is removed and the temperature drops below the threshold amount. The electrical schematic for this embodiment is shown in FIG. 5A and is referred to as the Series-Switch Configuration. This shows ON/OFF switch 12, which can be a single-pole, single-throw, push button switch; thermal switch 22, which can be a bi-metallic thermal switch that closes when the temperature rises; fan 3, such as a micro DC fan; and power source 8, such as a 3 to 5 volt DC battery.

Figure 5B:
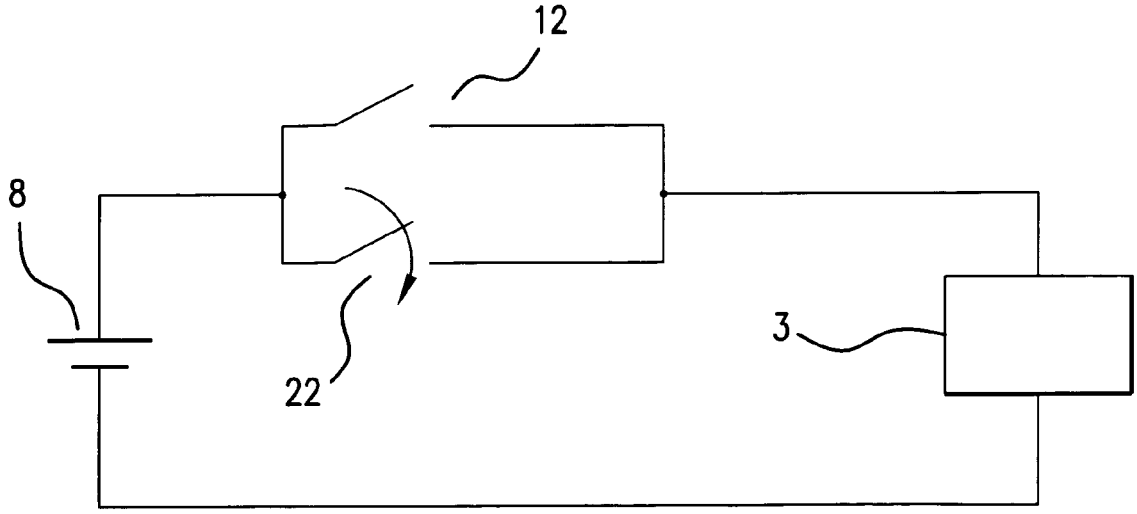
FIG. 5B shows an electrical diagram of an alternate parallel switch configuration.

In an additional embodiment, shown in FIG. 5B, the ON/OFF 12 and thermal 22 switches are connected in parallel. In this configuration, fan 3 can be activated by either the ON/OFF 12 or thermal control 22 switches. This embodiment provides greater flexibility by allowing the user to manually activate the fan by turning ON the switch 12 or letting the thermal switch 22 control the fan 3 based on the temperature inside the shoe. Control switch 22 preferably has an activation means to enable the conventional on/off switch 12 to be bypassed, although thermal switch 22 can also be utilized by itself without switch 12. When activated, the thermal switch 22 effectively bypasses the on/off switch 12 (which is then set to the Off position), so that rather than having to manually turn switch 12 on and off, fan 3 can be automatically operated depending on the temperatures sensed within shoe 2.

In these examples, a bimetallic snap-acting thermostat that opens and closes, based on temperature settings within shoe 21, is preferably used. Practical, miniature thermal switches, based on bimetallic strip technology, can be used which provide SNAP-ON and SNAP-OFF functionality and require no power. This drawing shows ON/OFF switch 12, such as a single-pole, single-throw, push button switch; thermal switch 22, including a bi-metallic thermal switch that closes when the temperature rises; fan 3, such as a micro DC fan; and power source 8, such as a 3 to 5 volt DC battery. Other embodiments that utilize a setting means that allows the automatic on and off temperatures to be adjusted in the field can also be used. In a variation of this embodiment, the thermal control switch 22 can be used without switch 12.

Although not shown in the drawings, the present invention can be provided with channels and other means extended through the sole and/or upper or covering of the shoe to improve airflow and circulation around the foot. These channels can be formed within the shoe, such as in a fore and aft direction, so that air can be circulated from the front to the back, and vice verse. Channels can also be extended up and down, and side to side, to enable air to circulate around the entire foot.

Figure 3:
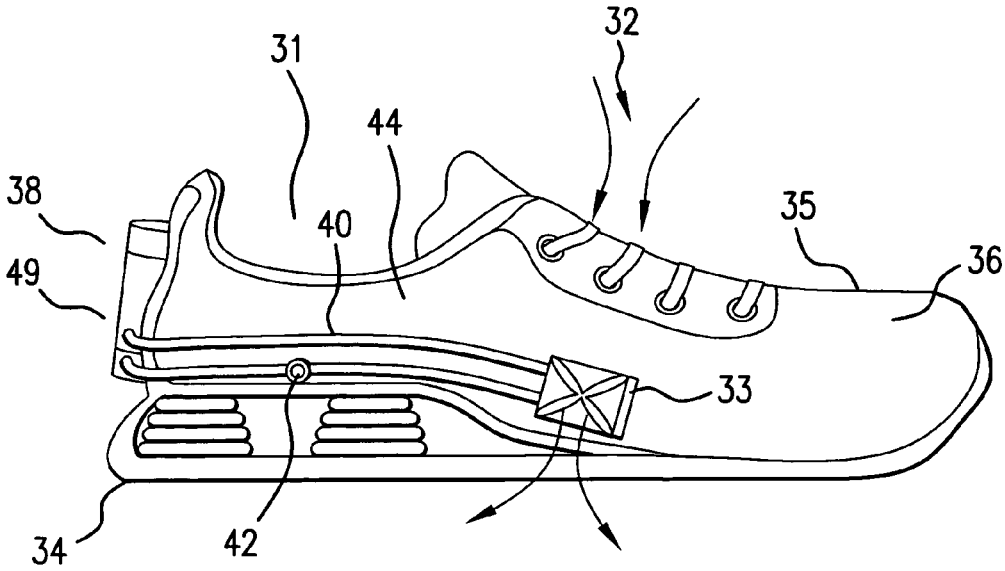
FIG. 3 shows an embodiment with a dual fan design, wherein the fans are located on the instep, and have a push-pull design.
Figure 4:
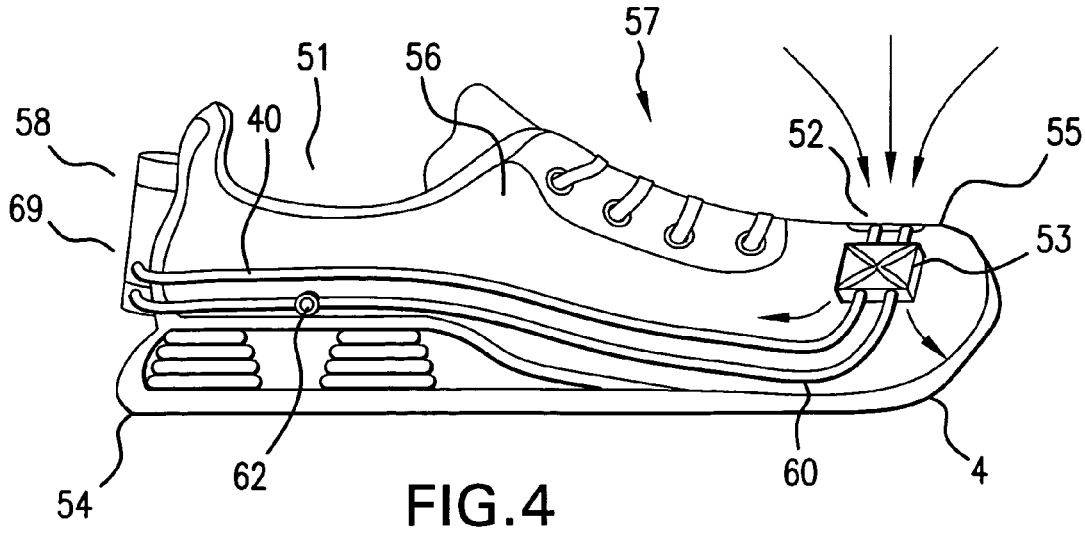
FIG. 4 shows an embodiment with a dual fan design, wherein the fans are located over the toe area, and have a push-pull design.

FIGS. 3 and 4 show additional embodiments 31, 51, respectively, with certain features that are similar to the first embodiment, except that in these embodiments, dual fans, one on either side of the shoe, are used. In FIG. 3, for example, shoe 31 is shown with one fan 33 located on one side of instep 44, and another fan 32 (not shown) located on the other side. Shoe 31 otherwise has a similar sole 34, upper or covering 35, fabric 36, battery 38, wire or cable 40, on/off switch 42, and heel 49, etc.

With dual fans, one fan 32 is preferably designed to push air into the shoe, and the other fan 33 is preferably designed to pull air out of the shoe (see arrows), which helps exhaust air and improve air circulation within the shoe. While the fans are shown and described as being located at the instep 44, they can also be mounted elsewhere on the shoe, in virtually any location within the shoe. Locating the fans can be important, such as in cases where the aesthetics and appearance are important, i.e., they can be located where they are least noticeable. Locating the fans above the toes also improves comfort to the wearer. In any case, the fan is preferably provided with similar protecting and mounting means, as discussed in connection with the previous embodiments.

In FIG. 4, a similar shoe 51 is shown, except that in this case, the dual fans 52, 53 are located more toward the toe area 57, similar to the first embodiment. This embodiment 51 has dual fans, 52, 53, one that pushes air into the shoe, and another that pulls air out of the shoe. Shoe 51 otherwise has a similar sole 54, upper or covering 55, fabric 56, battery 58, wire or cable 60, on/off switch 62, and heel 69, etc.

In the case of exhausting air out of the shoe, the present invention contemplates that a deodorizer pouch can be installed to either eliminate offensive odors or add fragrance. A similar deodorizer or pouch can also be used in connection with pushing air into the shoe, if desired.

The fans of the present invention can be made using conventional micro fan technology. A review of current fan technology reveals that small micro fans, ranging in size from 8 mm×8 mm×5 mm, to well over 40 mm×40 mm×8 mm, are available and will run efficiently on 3 to 5 volt potentials at 40 to 70 mA. Because of their extremely small size, these efficient micro fans can be seamlessly integrated into the design of the shoe with minimal impact on the shoe's appearance. These efficient micro fans are capable of moving between 0.1 cubic feet of air per minute (CFM) to several cubic feet per minute (CFM), thus providing sufficient airflow to cool the foot. For reference, FIG. 8 includes the specifications for a number of existing small, brushless, DC powered fans that can be integrated into the shoe to provide sufficient airflow, operate at reasonable potentials and consume less than a few tenths of a watt in total power. These allow the fan to run continuously for 8 to 10 hours between charges.

Preferably, there are several power source and charging options available in connection with the present invention. The battery itself should be small, disposable and replaceable. A review of different batteries to determine the state of the battery technology reveals that small rechargeable battery packs can easily deliver on the order of 400 mAHours to 1800 mAHours of service at 3 to 5 volt potentials. These battery packs are commonly used in wireless telephones or other mobile devices. Both Nickel-Cadmium (NiCd) and Nickel Metal Hydride (NiMH) batteries have the power density to deliver a potential of 5 volts at greater than 400 mAHours in a volume of less than 2 cubic inches. Based on Ni battery cell technology, which delivers 1.2 volts per cell, a battery pack with three or four cells will provide the required potential of 3.6 volts or 4.8 volts, respectively. Other types of batteries are also contemplated.

In the embodiments shown, a small, detachable, rechargeable battery pack that can be snapped into the heel is shown. Being able to remove the battery pack from the heel makes it easy to recharge. For example, if the pack is easily removed, the battery can be plugged into the wall outlet for recharging, and once the battery is fully charged, the battery can be reinserted back into the heel. An additional battery pack can also be provided to allow the user to wear one pair, while charging another for the next day.

Alternatively, the recharging feature can come with a wall charger and plug/jack that can be inserted into a socket located on the shoe that connects to the battery. In this embodiment, a charger with a cord is preferably provided which can be plugged into the wall outlet, and that has a separate cord with a plug or jack that can be inserted into the socket located on the shoe, which connects to the battery. This way, the user can charge the battery by plugging the charger into the wall outlet, and plugging the jack into the shoe socket, without removing the battery from the shoe.

In another embodiment, a small, rechargeable battery with an inductive charging mat can be provided. In this case, a flat charging mat is provided on which each shoe can be placed. The mat has a cord that can be plugged into the wall outlet, and has a coil that functions as the primary coil of a transformer to inductively couple power to the secondary coil located at the base of the battery pack in the heel of the shoe. This inductively coupled charging allows the battery pack to be recharged without requiring direct connections between the battery pack and the recharging power source. The user simply places the shoes in the prescribed position on the mat, such that the secondary pickup coils at the heel of the shoe are in close proximity to the primary coils on the charging mat. This could be done in the evening when the user goes to sleep to allow the battery pack to fully charge for the next day.

The user, in such case, can use the mat either with the shoes on or off. For example, the user could take the shoes off, and place them on the mat for recharging, in the evening. On the other hand, the user could also place his or her shoes on the charging mat with the shoes on. For example, the user can place the mat under his or her desk at the office, wherein he or she can place the shoes on the mat to recharge the batteries while seated at the desk.

The rechargeable battery can also be adapted with a mechanical self-charging feature that is operated by motion. In this approach, the mechanical motion of walking or running is used to charge the battery.

All components of the shoe are preferably water proof or otherwise resistant to water damage, as well as impact-resistant.

In order for the invention to find application and wide acceptance in the market place, the battery and fan combination is preferably able to run continuously for 8 to 10 hours without charging. This practical design allows the user to wear the shoe in comfort for a full day before requiring a recharge.

What is claimed is:

1. A shoe having a sole and an upper, comprising:
at least one micro-fan located on the upper;
a protective cover for the fan located on the upper in proximity to the fan;
a power source for providing power to the fan; and
a switch for turning the fan on and off located on the shoe.

2. The shoe of claim 1, wherein the sole and/or upper are provided with channels or other formations that help to circulate air within the shoe.

3. The shoe of claim 1, wherein the switch comprises a push-button on/off control located on the instep for allowing the switch to be activated by the wearer's other shoe or foot.

4. The shoe of claim 1, wherein the switch comprises a thermostat or other temperature sensor that enables the fan to be automatically turned on and off when a predetermined temperature is sensed inside the shoe.

5. The shoe of claim 1, wherein the protective cover comprises a mesh extended over the exterior of the fan, wherein the mesh helps to prevent debris and other particles from entering into the fan.

6. The shoe of claim 1, wherein the protective cover comprises two layers of porous fabric material extended on the top and bottom sides of the fan, wherein the material is sewn or otherwise incorporated into the fabric or material of the upper.

7. The shoe of claim 1, wherein the protective cover comprises a relatively stiff cover material to help prevent the fan from becoming damaged.

8. The shoe of claim 1, wherein the power source is a rechargeable battery.

9. The shoe of claim 1, wherein the battery is incorporated into a pack that can be snapped into the heel of the shoe.

10. The shoe of claim 8, wherein the battery comes with a wall charger and plug/jack for easy recharging.

11. The shoe of claim 8, wherein the battery comes with an inductive charging mat on which the shoe can be positioned, wherein inductive coils are provided to automatically recharge the battery by placing the shoe on the mat.

12. The shoe of claim 8, wherein the battery is self-charging based on motion.

13. The shoe of claim 1, wherein two fans are provided on the shoe, a first fan that pushes air into the shoe from outside, and a second fan that pulls air from inside the shoe outward.

14. The shoe of claim 13, wherein the first and second fans are located on or near a toe section of the upper.

15. The shoe of claim 1, wherein the fan is located on an instep section of the upper.

16. The shoe of claim 1, wherein a deodorizer pouch or bladder is provided in the shoe.

17. The shoe of claim 1, wherein the shoe comprises at least one feature taken from the group consisting of:
a) a fan having a size ranging from 8 mm×8 mm×5 mm to 40 mm×40 mm×8 mm;
b) a fan having a volume capacity ranging from 0.1 cubic feet per minute to several cubic feet per minute;
c) a fan having an energy consumption of less than a few tenths of a wall in total power; and
d) a battery that allows the fan to run continuously for at least 8 to 10 hours between charges.

18. A shoe having a sole and an upper, comprising:
at least one micro-fan located on the upper above the toes for pushing air down onto the toes of the wearer;
a protective cover for the fan located on the upper in proximity to the fan;
a power source for providing power to the fan; and
a switch for turning the fan on and off located on the shoe.

19. The shoe of claim 18, wherein the shoe comprises at least one feature taken from the group consisting of the following:
a) channels or other formations that help to circulate air within the shoe;
b) a push-button on/off control switch located on the instep for allowing the switch to be activated by the wearer's other shoe or foot;
c) a thermostat or other temperature sensor that enables the fan to be automatically turned on and off when a predetermined temperature is sensed inside the shoe;
d) a mesh extended over the exterior of the fan, wherein the mesh helps to prevent debris and other particles from entering into the fan;
e) two layers of porous fabric material extended on the top and bottom sides of the fan, wherein the material is sewn or otherwise incorporated into the fabric or material of the upper;
f) a relatively stiff cover material to help prevent the fan from becoming damaged;
g) a rechargeable battery;
h) a battery incorporated into a pack that can be snapped into the heel of the shoe;
i) a wall charger and plug/jack for easy recharging of the battery;
j) an inductive charging mat on which the shoe can be positioned, wherein inductive coils are provided to automatically recharge the battery by placing the shoe on the mat;
k) a self-charging battery based on motion;
l) a first fan that pushes air into the shoe from outside, and a second fan that pulls air from inside the shoe outward; and
m) a deodorizer pouch or bladder in the shoe.

20. The shoe of claim 18, wherein the shoe comprises at least one feature taken from the group consisting of:
a) a fan having a size ranging from 8 mm×8 mm×5 mm to 40 mm×40 mm×8 mm;
b) a fan having a volume capacity ranging from 0.1 cubic feet per minute to several cubic feet per minute;
c) a fan having an energy consumption of less than a few tenths of a watt in total power; and
d) a battery that allows the fan to run continuously for at least 8 to 10 hours between charges.

* * * * *